United States Patent [19]

Okuda

[11] Patent Number: 4,572,650

[45] Date of Patent: Feb. 25, 1986

[54] SIZE DETECTING DEVICE OF A COPY DOCUMENT SUITABLE FOR ELECTROPHOTOGRAPHIC COPYING MACHINE

[75] Inventor: Masakiyo Okuda, Kashiwara, Japan

[73] Assignee: Sharp Kabushiki Kaisha, Osaka, Japan

[21] Appl. No.: 542,211

[22] Filed: Oct. 14, 1982

[30] Foreign Application Priority Data

Oct. 25, 1982 [JP] Japan ..... 57-187966

[51] Int. Cl.[4] ..... G03G 21/00

[52] U.S. Cl. ..... 355/3 SH; 250/560; 355/3 R

[58] Field of Search ..... 355/14 SH, 3 SH, 14 R, 355/3 R; 250/560

[56] References Cited

U.S. PATENT DOCUMENTS 4,338,020 7/1982 Yakawa et al. ..... 355/14 SH
4,341,460 7/1982 Kohyama ..... 355/14 SH
4,456,372 6/1984 Yamauchi ..... 355/14 SH

*Primary Examiner*—R. L. Moses
*Attorney, Agent, or Firm*—Birch, Stewart, Kolasch & Birch

[57] ABSTRACT

An electrophotographic copying machine includes a device for detecting the size of a copy document on a document table. The device has at least two light receiving elements directed to detect, in combination, a single size of the copy document. The two light receiving elements are responsive to the size of the copy document for outputting two document size signals. The document size signals have the same signal levels when the two light receiving elements are both prevented from receiving light by the document, or different signal levels when either of the light receiving elements is prevented from receiving light by the document. The copying machine comprises a detection circuit responsive to the document size signals for calculating the possible difference of the document size signal levels and detecting the particular size of the copy document.

5 Claims, 4 Drawing Figures

SIZE DETECTING DEVICE OF A COPY DOCUMENT SUITABLE FOR ELECTROPHOTOGRAPHIC COPYING MACHINE

BACKGROUND OF THE INVENTION

The present invention relates to an electrophotographic copying machine and, more particularly, to a device for detecting the size of a copy document on a document table for an electrophotographic copying machine.

An electrophotographic copying machine produces an electrostatic latent image on an optical-sensitive member. The latent image corresponds to an image on a copy document such as a manuscript or book to be copied. Toner particles are electrically adhered to the latent image, so that the latent image becomes visible to form a toner image.

The toner image is transferred onto a copy paper via a transference charger. Depending upon the size of the copy document, the size of the copy paper should be selected. To properly select the copy paper size, some sensors must be provided adjacent the document table for detecting the size of the copy document.

Conventionally, each of the sensors comprises a light receiving element. When the copy document is positioned on the document table, the copy document interrupts surrounding light from being incident upon the light receiving element. The copying machine is responsive to the output from the light receiving element for detecting the size of the copy document.

Since each of these sensors is directed to detect individual sizes of a plurality of copy documents, error detection can not be avoided, in particular, when the copying machine is disposed in the dark.

Therefore, it is desired to provide an improved detection device for detecting the sizes of the copy documents on the document table for preventing any error in detection.

SUMMARY OF THE INVENTION

Accordingly, it is an object of the present invention to provide an improved device for detecting the size of a copy document on a document table.

It is another object of the present invention to provide an improved device for detecting the size of a copy document on a document table based on the difference between the outputs of sensors.

It is a further object of the present invention to provide an improved electrophotographic copying machine comprising a device for detecting the size of a copy document on a document table based on the difference between the outputs of sensors.

Briefly described, in accordance with the present invention, an electrophtographic copying machine comprises a device for detecting the size of a copy document on a document table. The device comprises at least two light receiving elements directed to detect, in combination, a single size of the copy document. The two light receiving elements are responsive to the size of the copy document for outputting two document size signals. The document size signals have the same signal levels when the two light receiving elements are both prevented from receiving light by the document, and different signal levels when either of the two light receiving elements is prevented from receiving light by the document. The copying machine comprises a detection circuit responsive to the document size signal levels for calculating the possible difference between the document size signal levels and detecting the particular size of the copy document.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
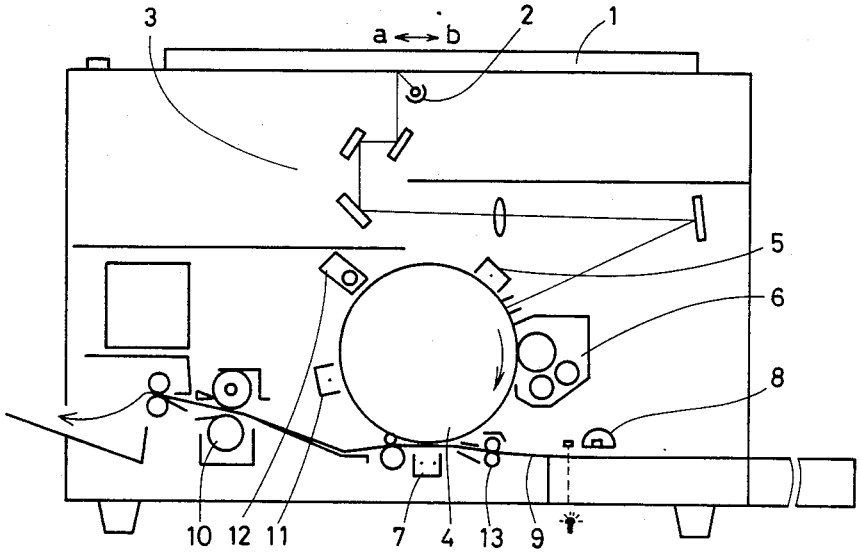
FIG. 1 shows a sectional view of an electrophotographic copying machine according to the present invention.

FIG. 1 shows a sectional view of an electrophotographic copying machine of the present invention. In a preferred form of the present invention, a type of electrophotographic copying machine for reciprocating a document table for carrying a copy document such as a manuscript or book is shown. However, it should be noted that the present invention can be applied to another type of electrophotographic copying machine comprising a part of an optical scanning system including lenses and mirrors, the part being moved along the document table.

The electrophotographic copying machine of FIG. 1 comprises a document table 1, a light source 2, an optical system 3, an optical-sensitive member 4, a pre-charger 5, a developing section 6, a transference charger 7, a paper pick-up roller 8 and a pair of paper supply rollers 13 for a paper 9, an image fixing device 10, a charge removal charger 11, and a cleaner 12.

The document table 1 is positioned at the top of the copying machine. The table 1 can be reciprocated in the directions a and b. On the table 1, a copy document such as a manuscript or book is disposed to which light is projected by the light source 2. The optical system 3 is used to focus a reflected image from the object onto the optical-sensitive member 4. The optical system 3 comprises lenses and mirrors for this purposes.

In a preferred from of the present invention, the optical scanning system 3 is fixed while the table 1 is moved. In another preferred form, it may be possible that part of the lenses and the mirrors forming the optical scanning system 3 is moved while the table 1 is fixed.

The optical-sensitive member 4 is formed around a drum. The pre-charger 5 is provided for uniformly pre-charging the optical-sensitive member 4 before the member 4 receives the reflected image.

Responsive to the reflected light image from the object, an electrostatic latent image is formed on the optical-sensitive member 4. The developing section 6 is provided for changing the latent image into visible toner image. The transference charger 7 is provided for electrostatically transferring the toner image upon the paper 9 which is picked up by the paper pick-up roller 8. The image fixing device 10 is provided for fixing the toner image on the paper 9, so that the image on the copy object is copied on the paper 9.

After the toner image is transferred on the paper 9, the remaining charges on the optical-sensitive member 4 are removed by the charge-removal charger 11. The cleaner 12 is provided for cleaning the toner particles remaining on the optical-sensitive member 4.

Figure 2:
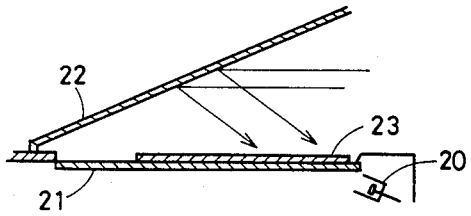
FIG. 2 shows a sectional view of a device for detecting the size of a copy document onto a document table equipped with a light receiving element according to the present invention.
Figure 3:
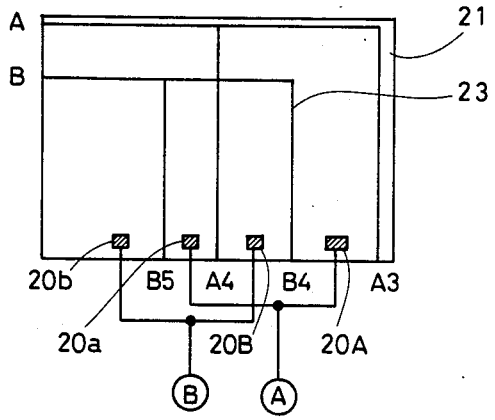
FIG. 3 shows a plan view of the document table of FIG. 2.

Responsive to a paper pick-up signal generated in response to the generation of a copy start signal, the paper pick-up roller 8 is rotated a full turn, so that a single sheet of the paper 9 is picked up. The picked-up paper 8 stops at the position of the pair of paper supply rollers 13. This is because the leading edge of the latent image on the optical-sensitive member 4 must correspond to the leading edge of the picked-up paper 9. Responsive to a position detection signal developed at the time when the object plate 1 is on the way in the light exposure direction b, the pair of paper supply rollers 13 are rotated to start the supply of paper 9. FIGS. 2 and 3 show a sectional view and a plan view of a device for detecting the size of a copy document on the document table 1 according to the present invention, respectively.

The device comprises some, preferably, four sensors 20, a document table plate 21, and a document cover 22. A copy document 23 is disposed onto the plate 21 as described above.

As FIG. 2 shows, the sensors 20 are positioned under the plate 21, but, obliquely separated from an end of the plate 21, so that the sensors 20 cannot receive the copy document scanning light from the light source 2. The sensors 20 receive the surrounding light as reflected by the document cover 22. Of course, an additional light emitting element may be provided for emitting light onto the light receiving element 20.

The sensors 20 may comprise a photodiode. The sensors 20 are responsive to the incidence of the surrounding light for outputting light receiving signals. The light receiving signals are applied to a detection circuit as will be described below.

As FIG. 3 shows, the copy document 23 is positioned so as to be in contact with the left side and the bottom side of a copy area of the plate 21. Therefore, the copy document 23 should interrupt the possible incident light onto the sensors 20. The sensors 20 are aligned along one side of the copy area. The top of the document 23 should be positioned at the top side of the copy area.

It is not intended in FIG. 3 that the sensors 20 are visible from the upright position, although it appears so in FIG. 3. It is intended in FIG. 3 that the respective sensors 20 are related to the particular sizes of the copy document 23.

With reference to FIG. 3, the light receiving elements 20 are directed to detect the copy document sizes. More particularly, a sensor **20*b* is disposed at the position where a B5 size paper which is the smallest size can interrupt the light incident upon itself. A sensor 20B is disposed at the position where a B4 size copy document 23 can interrupt the light incident upon itself and that an A4 size copy document 23 cannot interrupt the light incident upon itself. A sensor 20*a* is disposed at the position where an A4 size copy document 23 can interrupt the light incident upon itself and where the B5 size copy document 23 cannot interrupt the light incident upon itself. A sensor 20A is disposed at the position where an A3 size copy document 23 can interrupt the light incident upon itself and that the B4 size copy document 23** cannot interrupt the light incident upon itself.

Since the copy document 23 should be positioned as above described, according to the present invention, the document size can be detected by detecting the difference between the outputs of the sensors **20*b* and 20B by which a low level detection signal is generated. If no difference can be detected, a high level detection signal is generated. Of course, it is necessary that the sensors 20*b* and 20B should output the same level outputs regardless whether light may or may not be incident on these sensors. Similarly, it is necessary that the sensors 20*a* and 20A should output the same level outputs regardless of whether light may or may not be incident on these sensors. It may not cause any problem that the sensors 20*a* and 20*b*, or 20A and 20B** may output any different level signals from each other.

Figure 4:
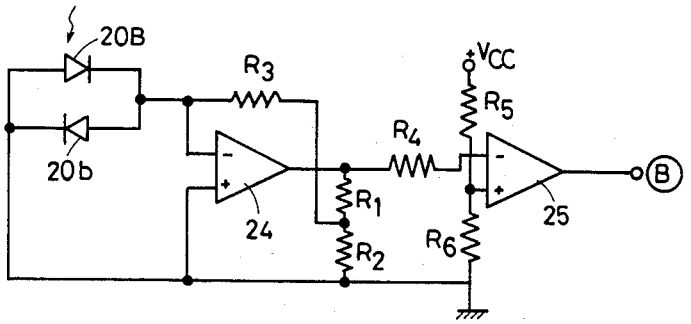
FIG. 4 shows a block diagram of a detection circuit according to the present invention.

FIG. 4 shows a block diagram of a detection circuit according to the present invention. The circuit of FIG. 4 is directed to detect the B4 and the B5 sizes of the document 23. To detect the A3 and the A4 sizes of the document 23, similar circuit may be needed which is omitted from the following description.

When a difference between the outputs of the sensors **20*b* and 20B is present, indicating that either sensor is prevented from receiving light and that the remaining sensor receives light, the circuit of FIG. 4 enables a low level signal to generate, indicating that the B5 size document 23 is disposed on the plate 21**.

The circuit of FIG. 4 comprises the sensors **20*b* and 20B, an operational amplifier 24, one to six resistors R1 to R6, and a comparator 25**.

The sensors **20*b* and 20B are connected in parallel and in the opposing direction. The outputs of the sensors 20*b* and 20B are entered into the input terminals of the operational amplifier 24. The output of the amplifier 24 is divided by the resistors R1 and R2, so that the divided voltage is fed back into the minus input terminal of the amplifier 24 via the feedback resistor R3. The output of the amplifier 24 is applied to the minus input terminal of the comparator 25 via the resistor R4. A divided voltage by the resistors R5 and R6 from the voltage +VCC of a power source is applied to the plus input terminal of the comparator 25. The comparator 25** outputs a copy size detection signal B .

When the B5 size document 23 is disposed on the plate 21, the sensor **20*b* is prevented from receiving the light and the sensor 20B can receive the light, so that the voltage difference between the outputs of the sensors 20*b* and 20B appears. The voltage difference is amplified by the amplifier 24, so that the amplifier 24 outputs a high level signal. This high level signal is applied to the comparator 25, so that the comparator 25** output a low level signal L.

When the B4 size document 23 is disposed on the plate 21, the sensors **20*b* and 20B are both prevented from receiving the light, so that they output the same level signals. Responsive to the same level signals, the amplifier 24 outputs the low level signal. Responsive to the low level signal from the amplifier 24 applied to the minus input terminal of the comparator 25, the comparator 25** outputs the high level signal H.

Thus, the voltage difference between the sensors **20*b* and 20B** permits the document size to be detected regardless the intensity of the surrounding light, so that accurate detection can be expected.

The following TABLE shows the relation between the document sizes and the output level from the comparator 25.

TABLE

| SIZE/OUTPUT | A | B |
|---|---|---|
| B5 | H | L |
| A4 | L | L |
| B4 | L | H |
| A3 | H | H |

In the above TABLE, the output B indicates the output of the comparator 25 of FIG. 4 related to detect the B4 and the B5 sizes. The output A indicates the output of an additional comparator for detecting the A3 and the A4 sizes.

Responsive to the outputs of the comparator 25, a control circuit of the electrophotographic copying machine provides a control signal necessary for operating the copying machine.

While only certain embodiments of the present invention have been described, it will be apparent to those skilled in the art that various changes and modifications may be made therein without departing from the spirit and scope the present invention as claimed.

What is claimed is:

1. A device for detecting the size of a document to be copied in an electrophotographic copying machine, comprising:

a document table for supporting said document;

a reflective document cover for reflecting light associated with said copying machine and for reflecting surrounding light, said document cover being adjustably disposed in an overlying relationship to said document table;

optical scanning means operatively associated with said document disposed on said document table;

sensor means for determining the amount of light reflected from said document cover onto the document disposed on said document table, said sensor means including at least two light receiving elements directed to detect, in combination, a single size of said document;

said at least two light receiving elements being connected in parallel and in opposing directions wherein said light receiving elements output signals which are representative of the amount of light reflected from said document cover;

detection means responsive to said output signals for determining the size of said document, said detection means including operational amplifier means for amplifying said signals and applying said signals to a comparator means for comparing said output signals and calculating a difference between said signals, said calculated difference in output signals being representative of the size of said document.

2. The device of claim 1, wherein the sensors comprises a photodiode responsive to the incident light for generating a voltage.

3. The device of claim 1, wherein the sensor means comprises four sensors.

4. The device of claim 1, further comprising light emitting means for emitting light incident upon the sensors.

5. The device of claim 1, wherein the sensors are aligned in line.

* * * * *